United States Patent [19]

Sugiura et al.

[11] Patent Number: 4,831,219

[45] Date of Patent: May 16, 1989

[54] KEYBOARD

[75] Inventors: Koji Sugiura; Takaya Ibe, both of Tokyo, Japan

[73] Assignee: Kabushiki Kaisha Bandai, Japan

[21] Appl. No.: 227,502

[22] Filed: Aug. 2, 1988

Related U.S. Application Data

[63] Continuation-in-part of Ser. No. 96,030, Sep. 11, 1987, abandoned.

[30] Foreign Application Priority Data

May 18, 1987 [JP] Japan ..... 62-120726

[51] Int. Cl.[4] ..... H01H 13/70; A63F 9/06

[52] U.S. Cl. ..... 200/5 A; 235/145 R; 273/153 S; 341/22; 340/706; 200/512

[58] Field of Search ..... 200/5 A, 159 B, 308, 200/86 R, 329, 6 A, 340; 340/365 R, 709, 710; 235/145 R; 174/68.5; 341/22, 23; 273/153 S; 446/123

[56] References Cited

U.S. PATENT DOCUMENTS

| | | | |
|---|---|---|---|
| 3,699,294 | 10/1972 | Sudduth | 200/5 A X |
| 3,860,771 | 1/1975 | Lynn et al. | 200/5 A |
| 4,127,740 | 11/1978 | LaMarche | 174/68.5 |
| 4,408,103 | 10/1983 | Smith, III | 200/6 A |
| 4,580,018 | 4/1986 | Yoshihara | 200/5 A |
| 4,659,879 | 4/1987 | Hasegawa | 200/5 A |
| 4,720,609 | 1/1988 | Hochgesang et al. | 200/5 A |

*Primary Examiner*—J. R. Scott

*Attorney, Agent, or Firm*—R. Gale Rhodes, Jr.

[57] ABSTRACT

A keyboard including a plurality of key switches and a plurality of keys mounted slidably on the keyboard over the key switches, each key overlying one of the key switches and the top of each key provided with a marking, upon each key being depressed into engagement with the underlying key switch, the key switch being operated to provide an indication of the marking provided on the top of the depressed key, and the number of plurality of keys being less in number by one than that of the key switches to provide a vacant key space on the keyboard to allow the keys to slide freely two-dimensionally over the key switches and through the vacent key space to permit each key to be slid over and overlie each of the key switches in a pattern as desired.

10 Claims, 4 Drawing Sheets

KEYBOARD

CROSS-REFERENCE TO RELATED APPLICATION

This application is a continuation-in-part of patent application Ser. No. 07/096,030, entitled Keyboard, filed Sept. 11, 1987 now abandoned, and assigned to the same assignee as this application.

BACKGROUND OF THE INVENTION

The present invention relates generally to a keyboard for use in an information processing apparatus, and more particularly it relates to a keyboard including a plurality of keys which may be rearranged in different positions on the keyboard to facilitate operator use and wherein the bottom of each key is provided with a different plurality of protrusions identifying the marking on the top of the key whereby upon the key being depressed by the operator the key produces the same response regardless of the position of the key on the keyboard.

Prior art keyboards are known which have different combinations of key positions, such as those seen in a JIS keyboard, the thumb-shift keyboard, numeric keyboard and the like; however, the operator cannot change the positions of the keys on these keyboards. Therefore, a problem known to these prior art keyboards is that the keys which are more frequently used are not necessarily positioned at optimum locations on the keyboard for operator use. More particularly, function keys, ten-keys (keys 0 through 9) or other keys frequently used by a particular operator cannot be rearranged in their keyboard positions once they are fixed. A further problem known to these prior art keyboards is that they do not facilitate use by left-handed operators. Further, the prior art keyboards have no concept of using the keyboard itself as a toy, except that a television game can be played with certain of these prior art keyboards.

SUMMARY OF THE INVENTION

It is the object of the present invention to provide a new and improved keyboard solving the above-noted prior art keyboard problems.

An embodiment of the keyboard of the present invention satisfying this object may include a plurality of key switches provided on the keyboard, each key switch including a predetermined number of switch elements positioned thereon in a predetermined pattern, each switch element including a pair of normally open electrical contacts, switch elements positioned in the same positions in said predetermined patterns on the key switches having one of the electrical contacts of the pair of each switch element electrically interconnected with one another and also electrically interconnected to a first common terminal to provide electrical interconnections of the one electrical contact and first common terminals equal in number to the predetermined number, and the other electrical contact of the pair of all of the switch elements of all of said key switches being electrically interconnected to a second common terminal; a plurality of keys provided on the keyboard, each key overlying one of the key switches, the top of each key provided with different marking such as a different character, figure, number, symbol or the like, and the bottom of each key provided with a plurality of protrusion positions equal in number to the predetermined number and positioned on the bottom of the key in the predetermined pattern and the protrusion positions overlying the switch elements, the bottom of each key provided with at least two protrusions located in combination in a different two of the protrusion positions in the predetermined pattern and being indicative of the marking, one of the protrusions having a height h1 and the other protrusion having a height h2, height h2 being greater than height h1; and upon each of the keys being depressed the protrusion of greater height h2 engaging the underlying switch element to close the pair of electrical contacts thereof to complete a first electrical circuit between one of the first common terminals and the second common terminal and upon the key being further depressed the other protrusion of height h1 subsequently engaging the underlying switch element to close the pair of electrical contacts thereof to complete a second electrical circuit between another of the first common terminals and the second common terminal.

DETAILED DESCRIPTION OF THE INVENTION

Figure 1:
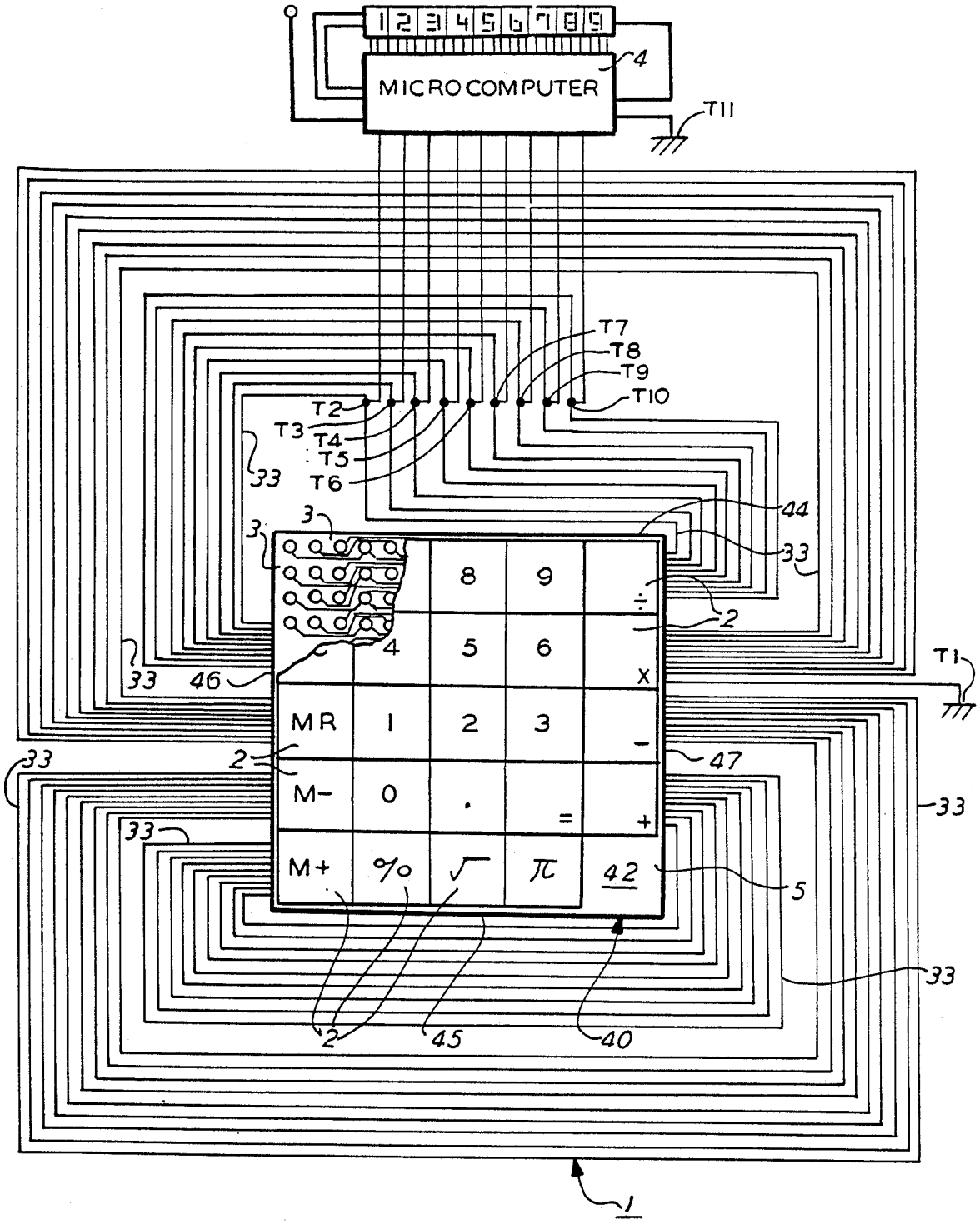
FIG. 1 is a schematic illustration, generally in plan view, of an embodiment of the keyboard according to the present invention.

Referring now to the drawings, and in particular to FIG. 1, a preferred embodiment of the keyboard of the present invention is shown and indicated by general numerical designation 1; the utility of the keyboard 1 is illustrated by use of the keyboard in association with an input device or information processing apparatus such as the microcomputer 4 of FIG. 1. It will be understood generally, and referring to FIG. 1, that the keyboard 1 is for completing electrical circuits between the common terminal or ground T1 and the common terminals T2 . . . T10 and that the microcomputer 4, in turn, is for completing electrical circuits between the common terminals T2 . . . T9 and the common terminal or ground T11; such electrical circuits are indicative of the respective markings on the tops of the keys 2 and are completed in response to the depression of the keys by an operator as taught in detail below. It will be further understood generally from FIG. 1 that the keyboard 1 in the preferred embodiment shown is provided with 24 keys 2 including the ten-keys (keys 0–9) and other functional keys such as a memory key, add, subtract, divide, multiply, etc., as shown, and that as taught in detail below the keys 2 are disposed removably on the keyboard 1, are mounted for sliding two-dimensional movement on the keyboard and that the keyboard 1 is provided with a vacant key space 5 which permits the keys 2 to be rearranged on the keyboard in different positions to enhance or facilitate operator use of the keyboard. Still further generally, and as also taught in detail below, it will be understood that the keyboard 1 is provided with structure which permits a key 2 upon being depressed to complete the same circuits between the common terminal T1 and the common terminals T2 . . . T10 regardless of the position on the keyboard 1 occupied by the key 2.

Figure 2A:
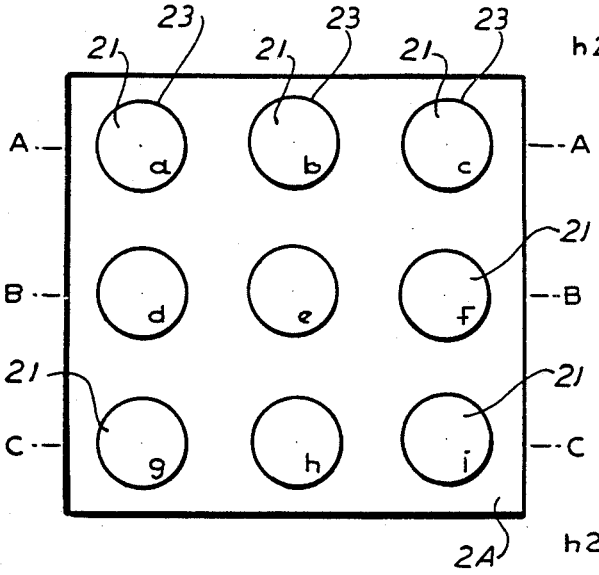
FIG. 2A is a bottom view of a key.
Figure 4:
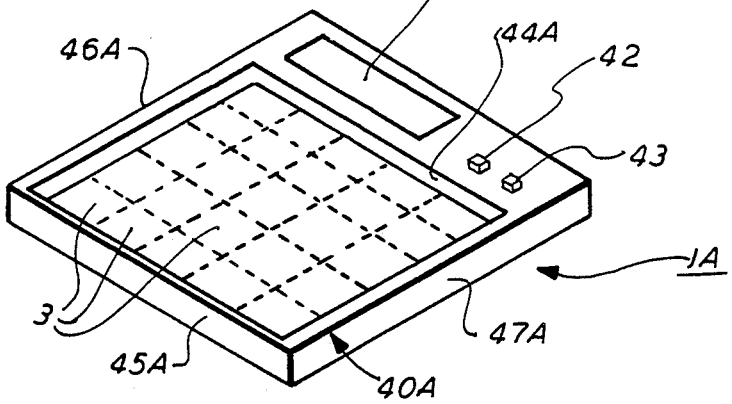
FIGS. 4 and 5 are perspective views of an alternate keyboard frame of the present invention.
Figure 5:
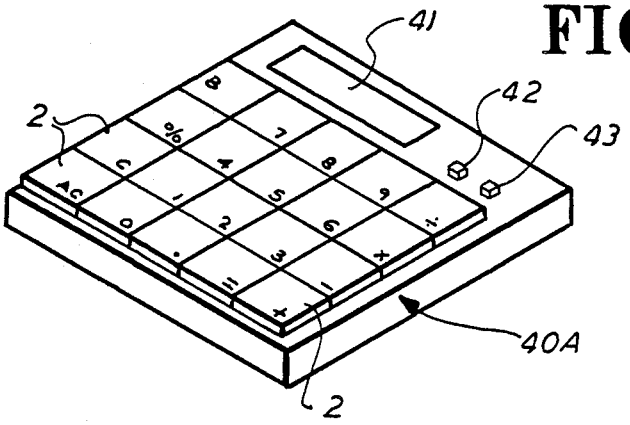

Referring still to FIG. 1 and recalling that FIG. 1 is a top plan view, it will be further understood that the keyboard 1 may include a frame mounted substantially horizontally and indicated by general numerical designation 40. Frame 40 is of generally rectangular box-like construction open at the top and includes a bottom 42 and pairs of upwardly extending opposed side walls 44 and 45 and 46 and 47. An alternate frame embodiment 40A is shown in FIGS. 4 and 5 and includes pairs of upwardly extending opposed side walls 44A and 45A and 46A and 47A and further includes a liquid crystal display 41 for the microcomputer 4 (FIG. 2) and on and off switches 42 and 43. Generally, it will be understood that the bottoms, e.g. bottom 42 of FIG. 1, of the frames 40 and 40A are for supporting and providing mounting for key switches 3, 25 in number in the preferred embodiment arranged in five columns and five rows (best seen in FIG. 3), and that the pairs of opposed side walls 44 and 45 and 46 and 47 of frame 40 (FIG. 1) and 44A and 45A and 46A and 47A (FIGS. 4 and 5) are for supporting the keys 2 in free sliding two-dimensional movement on top of or over the key switches 3 in accordance with the teachings of the present invention and for a purpose taught in detail below.

Figure 3:
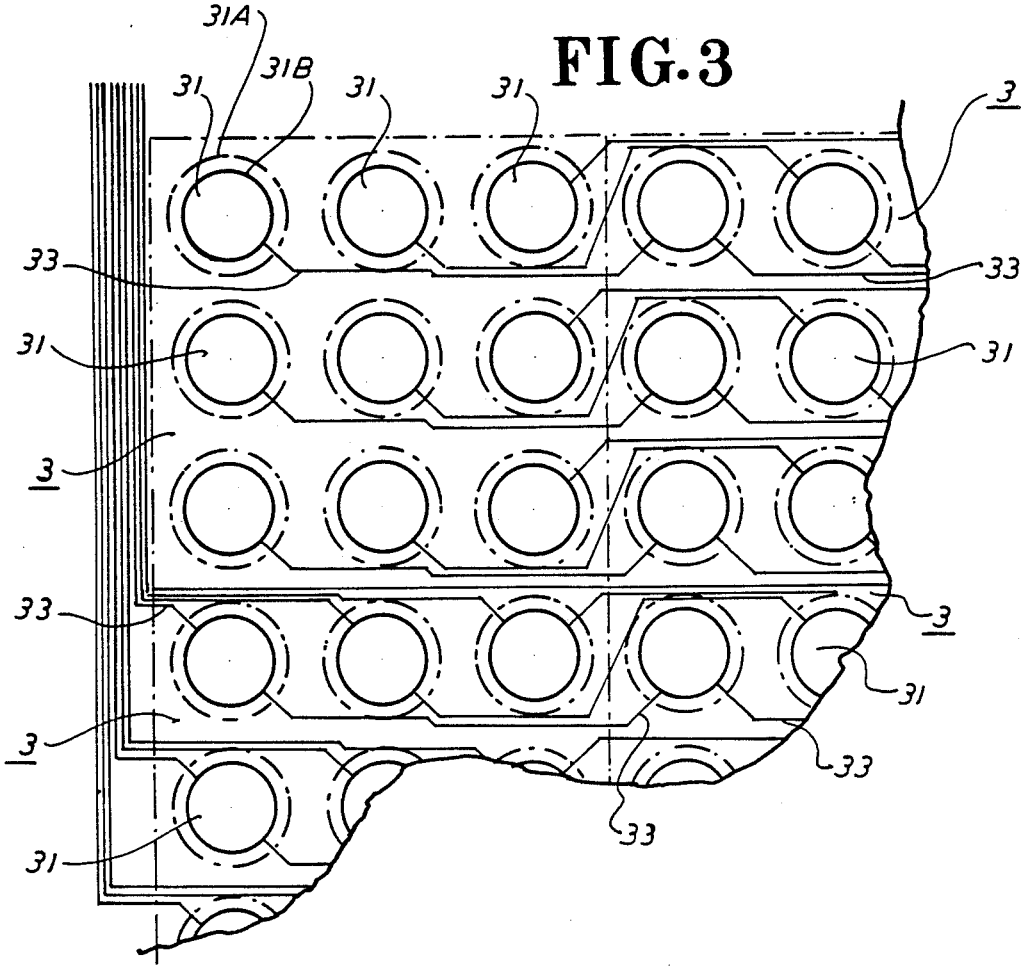
FIG. 3 is an enlarged partial plan view showing key switches and switch elements with which they are provided.
Figure 6:
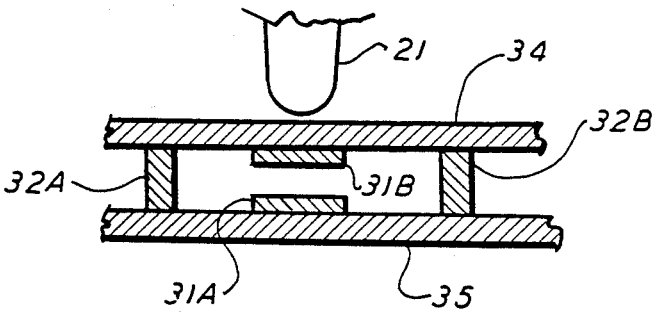
FIG. 6 is a partial cross-sectional view of keyboard structure of FIG. 1.

Referring now particularly to FIG. 3, it will be understood that in the preferred embodiment each key switch 3 includes nine switch elements 31 arranged or positioned thereon in a predetermined pattern of three rows and three columns. Each switch element 31 includes a pair of normally open electrical contacts, a fixed bottom or underlying electrical contact 31A and a movable top or overlying electrical contact 31B. In FIG. 3 the underlying or bottom contact 31A is shown in broken outline and the top or overlying contact 31B is shown in solid outline. It will be understood, and referring to FIG. 6, that each pair of normally open electrical contacts 31A and 31B is maintained normally open by any one of several structures or manners known to the art, such as the spacers 32A and 32B, and that the top or upper electrical contacts 31B are formed suitably under a layer of flexible film 34, such as a layer of vinyl chloride, polyethylene, terephthalate, urethane or the like, and that the fixed bottom or underlying electrical contacts 31A are formed suitably on a printed circuit board 35.

Further, in accordance with the particular teachings of the present invention, it will be generally understood that the upper or overlying electrical contacts 31B of the switch elements 31 positioned in the same positions in the three rows and three columns of the key switches 3 are electrically interconnected to each other and are electrically interconnected to one of the common terminals T2 . . . T10. Specifically, and by way of example, it will be understood from FIGS. 3 and 1 that all of the upper or overlying electrical contacts 31B of all of the switch elements 31 positioned in the upper lefthand corner of all of the key switches 3 are electrically interconnected by conductors 33 and are electrically interconnected to the common terminal T2 of FIG. 1; the serpentine path of the electrical conductors 33 providing these electrical interconnections may be better understood by reference to FIG. 1. Similarly, the upper or overlying electrical contacts 31B of the other switch elements 31 positioned in the same or corresponding positions in the rows and columns of key switches 3 are also all electrically interconnected and electrically interconnected to another of the common terminals T3 . . . T10 by other electrical conductors whose serpentine paths are also better seen in FIG. 1; thus, it will be understood that the electrical interconnection of the upper or overlying contacts 31B and the common terminals T2 . . . T10 are equal to nine in number the same number as the switch elements 31 included or provided in each key switch 3. In accordance with still further teachings of the present invention, it will be understood that all of the underlying or bottom contacts 31A of all of the switch elements 31 of all of the key switches 3 are electrically interconnected and electrically interconnected to the common terminal T1 of FIG. 1, such electrical interconnections of the underlying or bottom electrical contacts 31A being by any of several methods known to those skilled in the art. The underlying or bottom contacts 31A are mounted fixedly on the bottom 42 of the frame 40.

Figure 2B:
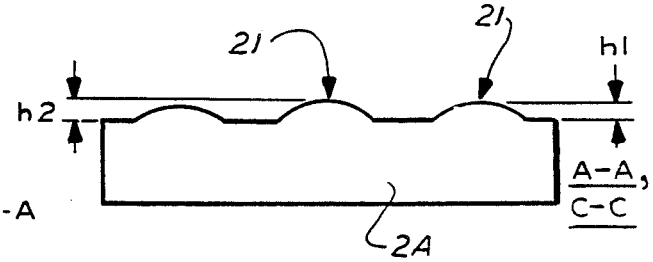
FIG. 2B is a cross-section of the key along lines A—A and C—C of FIG. 2A.
Figure 2C:
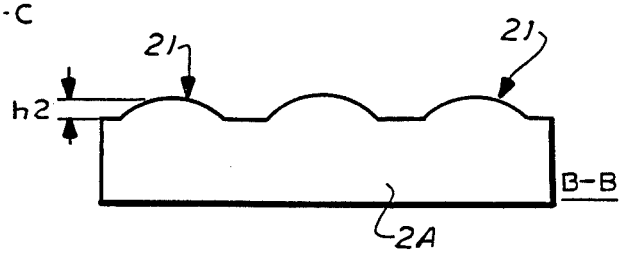
FIG. 2C is a cross-section of the key along line B—B of FIG. 2A.

Further generally, and referring to FIGS. 1 and 3, it will be understood that as viewed in plan the keys 2 and key switches 3 are of the same size and rectangular shape and that each key 2 is for overlying one of the key switches 3. More specifically, and referring to FIG. 2A through FIG. 2C, an exemplary key 2A is illustrated in detail. From FIG. 2A, a bottom view of exemplary key 2A, it will be understood that the bottom of each key is provided with nine protrusion positions 23 arranged in the same pattern of rows and columns as the switch elements 31 of the key switches 3 and with the same spacings therebetween, and it will be further understood by way of example with regard to exemplary key 2A that a protrusion 21 is provided in each protrusion position 23. It will be further understood that each protrusion position 23 is for overlying one of the switch elements 31 and that each protrusion 21 is for overlying and engaging to close the normally open electrical contacts 31A and 31B of the underlying switch element 31, by forcing them into engagement, upon the key 2A being depressed by the operator. In accordance with further particular teachings of the present invention, the protrusions provided in the four corner protrusion positions 23 (protrusion positions a, c, g, i) are provided with a height h1 and the protrusions provided in the other protrusion positions (protrusion positions b, d, e, f, h) are provided with a height h2; as shown in FIGS. 2B and 2C, the protrusion height h2 is greater than the protrusion height h1. In the preferred embodiment, it will be understood that each key 2 is provided with four corner protrusions 21 of height h1 (protrusion positions a, c, g, i) and that at least one protrusion 21 of greater height h2 is provided in at least one of the other protrusion positions (protrusion positions b, d, e, f, h). It will be further understood that these combinations of protrusions of heights h1 and h2 are used to identify a particular key and in particular to identify the marking provided on the top or face of each key such as a numeral 0 to 9, a symbol "x", "/", "−" or "+", a character "MR" and the like as illustrated on the tops of the keys 2 shown in FIG. 1. Accordingly, by way of example, it will be understood that the key 2 of FIG. 1 provided on its top with the marking "0" is provided on its bottom with four corner protrusions 21 of height h1 in the protrusion positions a, c, g, i, and one protrusion 21 of height h2 located in protrusion position b; the key 2 of FIG. 1 provided on its top with the marking "1" is provided with the noted four corner protrusions 21 of the height h1 and one protrusion 21 of height h2 located in protrusion position d; the key 2 of FIG. 1 provided on its top with the marking "5" is provided with the noted four corner protrusions and two protrusions 21 of height h2 provided in protrusion positions d and e; by way of further example, the key 2 of FIG. 1 provided on its top with the marking "MR" is provided with the noted four corner protrusions and three protrusions 21 of height h2 located in protrusion positions d, e, f.

In operation, if an operator depresses the center portion of the key 2 provided on its top with the marking "1," the protrusion 21 of greater height h2 and located in protrusion position d will first engage the underlying switch element 31 to close the normally open pair of electrical contacts 31*a* and 31*b* thereof to complete an electrical circuit between the common terminal T1 and common terminal T5 and as the operator continues to depress the key 2 the four corner protrusions of smaller height h2 located in protrusion positions a, c, g, i will subsequently engage the underlying switch elements 31 to close the normally open pairs of electrical contacts 31A and 31B thereof to complete four electrical circuits between the common terminal T1 and the common terminals T2, T4, T8, and T10; the completion of these electrical circuits will be detected by the microcomputer 4 and the microcomputer 4 in turn will complete corresponding electrical circuits to the common terminal T11 which in turn will illuminate the numeral "1" associated with the microcomputer 4 and illustrated in FIG. 1.

In the above-described embodiment, two types of protrusions, higher and lower protrusions have been used for generating a key code and a key input acknowledge code. However, all the protrusions may be used instead for generating a key code only. In this case, if the number of protrusions is n, then this arrangement can identify n powers of 2 keys. Also, in the above embodiment, although four lower protrusions have been assigned for generating a key input acknowledge code, this number is optional and may be any desired number.

Further, contact pairs may be formed at lower and higher positions in the keyboard for acting upon the lower and higher protrusions.

Apart from the above, the keyboard of this embodiment has one space for a key as indicated by 5 in FIG. 5. Therefore, this keyboard can be used as a toy for rearranging the numbers, figures and characters, by two-dimensionally moving each key using the one space 5.

Further, since the switch of this embodiment is arranged to provide a closed circuit between an input interface and ground, the number of input ports can be reduced. For example, in case of a keyboard having 50 keys, 15 input ports are required in an ordinary matrix connection. However, in this embodiment, only 6 input ports become necessary. If the matrix connection is applied to the embodiment, the number of input ports becomes five. Furthermore, since one terminals of the contact pairs are all grounded, good productivity, low cost, and low failure are insured.

Referring again particularly to FIG. 1, it will be understood in accordance with the further teachings of the present invention that in the preferred embodiment the keys 2 equal 24 in number and that the switch elements 31 equal 25 in number whereby the vacant key space 5 is provided. The keys 2 are each an individual key, physically distinct from the others, and as described above are provided on the keyboard 1 and maintained thereon by the force of gravity and by the upwardly extending opposed pairs of walls 44 and 45 and 46 and 47 of the frame 40; hence, it will be understood that the keys 2 are freely movable two-dimensionally up and down and across the key switches 3 in the rows and columns thereof shown in FIG. 1, and this two-dimensional movement combined with the vacant key space 5 permits the keys 2 to be rearranged over different key switches 3, i.e. each key 2 may be slid over and overlie each of the key switches 3. It will still be further understood, and in accordance with the particularly teachings of the invention, that the above-described electrical interconnections between the upper of movable contacts 31B of the switch elements 31 and the electrical interconnections therebetween and the common terminals T2 . . . T10 permit a key 2 upon being depressed to provide the same electrical interconnections between the common terminal T1 and one or more of the common terminals T2 . . . T10 regardless of the key switch 3 over which the key 2 overlies. This permits the keys 2 of the keyboard 1 of the present invention to be rearranged on the keyboard 1 into any desired locations or positions thereon to greatly enhance or facilitate operator use by permitting the most frequently used keys 2 to be rearranged on the keyboard 1 in so-called "home positions," and greatly enhances and facilitates the use of the keyboard by a left handed operator.

Still further, it will be understood that by providing each key on its bottom with at least one protrusion of greater height h2 and one protrusion of smaller height h1, the depression of a key may be confirmed by the microcomputer of FIG. 1 two times, once upon the depression of the protrusion of greater height h2 and secondly upon the depression of the protrusion of smaller height h1. Still further, it will be understood, and as taught above, that in the preferred embodiment each key 2 is provided on its bottom with four corner protrusions (protrusion positions a, c, g, i) of smaller height h2 which provides a security or validity check to permit the microcomputer 4 to distinguish between an intentional or valid depression of a key 2 and an inadvertent or accidental depression of a key 2 which is typically accidentally or unintentionally depressed at an angle whereby not all four of the smaller corner protrusions will be depressed at least substantially simultaneously and hence the microcomputer 4 (FIG. 1) may interpret the failure of the establishment of a failure of the substantially simultaneous establishment of four electrical circuits to be an inadvertent or accidental depression of the key.

Figures 7, 8:
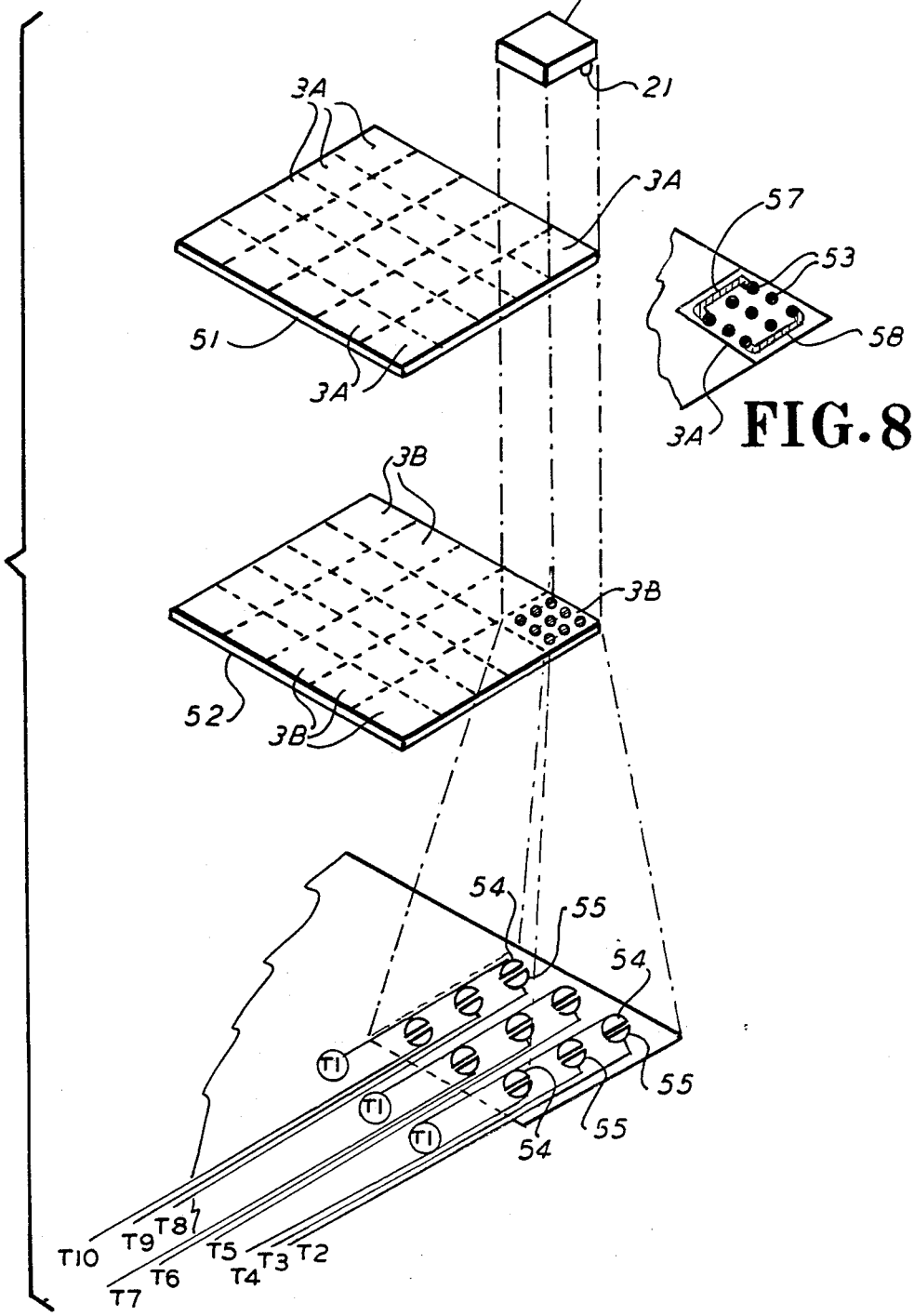
FIG. 7 is an exploded view of an alternate embodiment of a key switch of the present invention.
FIG. 8 is a partial view of the underside of the flexible sheet shown at the top of FIG. 7.

Referring now to FIGS. 7 and 8, there is shown an alternative embodiment of the key switches of the present invention wherein each key switch is comprised of an upper key switch element 3A and a lower opposed key switch element 3B. As shown in FIG. 7, this structure comprises an upper flexible silicone rubber sheet 51 which opposes and overlies a lower printed circuit board 52. The underside or bottom surface of silicone rubber sheet 51 is provided with 25 upper key switch elements 3A arranged in a predetermined pattern of five rows and columns as indicated by the dashed lines on the top of sheet 51, and the upper or top surface of the printed circuit board 52 is provided with 25 key switch elements 3B also arranged in the same predetermined pattern of five rows and five columns as indicated by the dashed lines on the top of circuit board 52.

An exemplary upper key switch element 3A is shown in FIG. 8, and it will be understood that this element includes nine carbon electrical contacts 53 arranged in a predetermined pattern of three rows and three columns as shown. It will be understood that such electrical carbon contacts 53 may be suitably applied to the under surface of the silicone rubber sheet 51 in the manner known to those skilled in the art.

An exemplary lower switch element 3B is shown in FIG. 7 and it will be understood that this element includes nine pairs of electrical contacts 54 and 55 arranged in a predetermined pattern of three rows and three columns as shown with each pair of normally open electrical contacts 54 and 55 residing in the same plane and being spaced apart as shown. It will be understood that upon assembly each electrical contact 53 on the underside of the silicone rubber sheet 51 overlies a pair of the normally open electrical contacts 54 and 55 on the top of the underlying printed circuit board 52. It will be still further understood that the pairs of normally open electrical contacts 54 and 55 are maintained in the electrically open condition by the associated overlying electrical contact 53 being separated or spaced therefrom by spacing members 57 and 58 formed suitably on the underside of the silicone rubber sheet 51 for each upper key switch element 3A, such as being made of rubber and suitably adhered to the silicone rubber sheet 51.

It will be still further understood, and referring to the lower portion of FIG. 7, that all electrical contacts 54 of each pair of normally open electrical contacts 54 and 55 are electrically interconnected to each other by suitable lead lines shown and are all electrically interconnected to a common terminal such as ground T1 shown in FIG. 1. Similarly, electrical contacts 55 of each pair of normally open contacts 54 and 55 positioned in the same positions in the three rows and three columns of the key switch 3B are electrically interconnected by suitable leads as shown and are electrically interconnected to one of the common terminals T2 . . . T10 (FIG. 1) in the same manner and for the same purpose as the upper or overlying electrical contacts 31B of FIG. 3 and as taught above in accordance with the particular teachings of the present invention. Thus, upon a key 2 (top of FIG. 7) being depressed a protrusion, e.g. protrusion 21 on the bottom of the key 2, is depressed into engagement with the underlying key switch (comprised of key switch elements 31A and 31B) and a carbon electrical contact 53 on the bottom of silicone rubber sheet 51 is forced into engagement with the pair of normally open underlying electrical contacts 54 and 55 to electrically interconnect the same and complete one of the above described electrical circuits between common terminal or ground T1 (FIG. 1) and one of the common terminals T2 . . . T10 (FIG. 1) to provide an indication that key 2 (FIG. 7) having its particular marking on the top thereof has been depressed. Accordingly, it will be understood that upon the alternate key switches embodiment of FIG. 7 being incorporated into the keyboard 1 of FIG. 1 instead of the key switch 3 of FIG. 3, keyboard 1 functions as described above.

It will be still further understood by those skilled in the art that the present invention is not limited to a keyboard of the general structure illustrated in FIG. 1 but may be embodied or utilized in other keyboards such as the above-noted JIS keyboard and the like and that the term keyboard as used herein and in the appended claims is used to mean any input device by which an operator can input information to apparatus such as the microcomputer 4 of FIG. 1 utilizing the present invention.

Lastly, it will be understood that many variations and modifications may be made in the present invention without departing from the spirit and the scope thereof.

What is claimed is:

1. A keyboard for being mounted substantially horizontally comprising:

a plurality of key switches;

means for mounting and allowing said plurality of keys to be mounted slidably over said key switches, each key overlying one of said key switches and the top of each key provided with a marking;

upon each key being depressed into engagement with the underlying key switch, said key switch being operated to provide an indication of the marking provided on the top of said depressed key; and the number of said plurality of keys being less in number by one than that of said key switches to provide a vacant key space on said keyboard to allow said keys to slide freely two-dimensionally in a substantially horizontal plane over said key switches and through said vacant key space to permit each key to be slid over and overlie each of said key switches.

2. A keyboard comprising:

a frame;

a plurality of keys mounted on said frame, the top of each key provided with a different marking;

a plurality of key switches mounted on said frame under said keys, each key switch including a predetermined number of normally open electrical contacts located at predetermined positions thereon and each key switch underlying one of said keys;

a different plurality of protrusions provided on the bottom of each key at different positions corresponding to different predetermined ones of said predetermined positions of said electrical contacts;

each plurality of protrusions including at least one protrusion of a first predetermined height and at least one protrusion of a second predetermined height greater than said first predetermined height, said at least one protrusion of said second predetermined height being indicative of the marking on top of the key on which it is provided; and upon each key being depressed said at least one protrusion of said second predetermined height engaging and closing at least one predetermined one of said normally open electrical contacts to provide an indication that said key has been depressed and upon said key being further depressed said at least one protrusion of said first predetermined height engaging and closing at least one other of said normally open contacts to provide an indication that said key has been intentionally depressed.

3. A keyboard according to claim 2 wherein said keys are mounted on said frame for free sliding two-dimensional movement over said key switches, wherein the number of said plurality of keys is less in number by one than that of said plurality of key switches to provide a vacant key space on said frame to allow said keys to slide freely two-dimensionally through said vacant key space to permit each key to be slid over and overlie each of said key switches.

4. A keyboard for being disposed horizontally, comprising:

a plurality of key switches, each key switch including a predetermined number of switch elements positioned thereon in a predetermined pattern, each switch element including a pair of normally open electrical contacts, switch elements positioned in the same positions in said predetermined patterns having one of said electrical contacts of each pair of contacts of each switch element electrically interconnected with one another and also electrically interconnected to a first common terminal to provide electrical interconnections of said one electrical contacts and first common terminals equal in number to said predetermined number, and the other electrical contact of said pair of electrical contacts of all of said switch elements of all of said key switches being electrically interconnected to a second common terminal;

horizontally disposed means for mounting and allowing said plurality of keys to be mounted slidably two dimensionally in a horizontal plane over said key switches each key overlying one of said key switches;

a plurality of keys provided on said keyboard, each key overlying one of said key switches, the top of each key provided with different marking such as a different character, figure, number, symbol or the like, and the bottom of each key provided with a plurality of protrusion positions equal in number to said predetermined number of said switch elements and positioned on the bottom of said key overlying said predetermined pattern, the bottom of each key provided with at least two protrusions located in combination in a different two of said protrusion positions in said predetermined pattern and being indicative of said marking, one of said protrusions having a height h1 and the other protrusion having a height h2, height h2 being greater than height h1; and upon each of said keys being depressed said protrusion of greater height h2 engaging the underlying switch element to close said pair of electrical contacts thereof to complete a first electrical circuit between one of said first common terminals and said second common terminal and upon said key being further depressed said other protrusion of height h1 subsequently engaging the underlying switch element to close said pair of electrical contacts thereof to complete a second electrical circuit between another of said first common terminals and said second common terminal, completion of said first and second electrical circuits combining to provide indications that a predetermined key having a predetermined marking on top thereof has been depressed and depressed intentionally.

5. Keyboard according to claim 4 wherein said key switches are greater in number than said keys by at least one to provide at least one key switch having no overlying key thereby providing at least one vacant key space, said slidable mounting of said keys over said keyboard and said vacant key space combining to permit said keys to be rearranged over said key switches, and said electrical interconnections of said one electrical contacts and said first common terminals permitting a predetermined key upon being depressed to complete said first and second electrical circuits regardless of which key switch said predetermined key overlies.

6. Keyboard according to claim 5 wherein said means for mounting and allowing said plurality of keys to be mounted slidably over said key switches includes a frame of generally rectangular box-like construction open at the top and including a bottom and pairs of upwardly extending opposed side walls, said frame disposed substantially horizontally; wherein said key switches are generally rectangularly shaped in plan view and are mounted fixedly on said bottom within said frame; and wherein said keys are generally rectangularly shaped and of the same size and shape as said key switches in plan view and are disposed substantially horizontally on said keyboard and are maintained on said keyboard overlying said key switches by the force of gravity.

7. Keyboard according to claim 6 wherein the bottom of each of said generally rectangularly shaped keys is provided with four corner protrusion positions and wherein a protrusion of height h1 is positioned at each of said four corner protrusion positions and wherein upon said key being subsequently further depressed as said said four corner protrusions of height h1 substantially simultaneously subsequently engage four underlying key switches to close said pairs of electrical contacts thereof to substantially simultaneously complete four of said second electrical interconnections between four of said first common terminals and said second common terminal.

8. Keyboard according to claim 4 wherein said pair of normally open electrical contacts comprise a top and bottom electrical contact spaced apart with the top contact overlying said bottom contact and wherein upon one of said protrusions engaging the underlying switch element to close said pair of electrical contacts thereof said top electrical contact is forced into engagement with said bottom electrical contact to complete one of said electrical circuits.

9. Keyboard according to claim 4 wherein said pair of normally open electrical contacts comprises a pair of electrical contacts spaced apart and positioned adjacent each other in the same plane and wherein said keyboard further comprises a third electrical contact for each pair of normally open electrical contacts, said third electrical contact overlying and spaced apart from said pair of normally open contacts and wherein upon one of said protrusions being depressed into engagement with said key switch said third electrical contact is forced into engagement with both of said pairs of normally open electrical contacts to electrically interconnect said pair of normally open contacts to complete one of said electrical circuits.

10. A keyboard comprising:

a plurality of key switches provided on said keyboard, each key switch including a predetermined number of switch elements positioned thereon in a predetermined pattern, each switch element including a pair of normally open electrical contacts, switch elements positioned in the same positions in said predetermined pattern having ones of said pairs of electrical contacts of said switch elements being electrically interconnected with one another and electrically connected to a first common terminal to provide electrical interconnections of said one electrical contacts and first common terminals equal in number to said predetermined number, and the other electrical contacts of said pairs of all of said switch elements of all of said key switches being electrically interconnected to a second common terminal;

means for mounting and allowing a plurality of keys to be mounted slidably over said key switches, each key overlying one of said key switches, the top of each key provided with different marking such as a different character, figure, number, symbol or the like, and the bottom of each key provided with at least one protrusion located in one of said protrusion positions in said predetermined pattern and being indicative of said marking; and upon each of said keys being depressed said protrusion engaging the underlying switch element to close said pair of electrical contacts thereof to complete an electrical circuit between one of said first common terminals and said second common terminal.

* * * * *